US012679583B2

(12) United States Patent
Heijn et al.

(10) Patent No.: US 12,679,583 B2
(45) Date of Patent: Jul. 14, 2026

(54) METHOD AND FILLING STATION FOR FILLING A CONTAINER COMPRISING A PRESSURIZED ADDITIVE CHAMBER

(71) Applicant: Widget World Wide B.V., Blaricum (NL)

(72) Inventors: Dennis Heijn, Blaricum (NL); Casper Alexander Koppelle, Blaricum (NL)

(73) Assignee: Widget World Wide B.V., Blaricum (NL)

( * ) Notice: Subject to any disclaimer, the term of this patent is extended or adjusted under 35 U.S.C. 154(b) by 205 days.

(21) Appl. No.: 18/551,407

(22) PCT Filed: Mar. 17, 2022

(86) PCT No.: PCT/NL2022/050143
§ 371 (c)(1),
(2) Date: Sep. 20, 2023

(87) PCT Pub. No.: WO2022/203501
PCT Pub. Date: Sep. 29, 2022

(65) Prior Publication Data

US 2024/0228083 A1 Jul. 11, 2024

(30) Foreign Application Priority Data

Mar. 25, 2021 (NL) ..... 2027832

(51) Int. Cl.
*B65B 31/10* (2006.01)
*B65B 31/00* (2006.01)
*B65D 81/32* (2006.01)

(52) U.S. Cl.
CPC ..... *B65B 31/003* (2013.01); *B65B 31/10* (2013.01); *B65D 81/3222* (2013.01)

(58) Field of Classification Search
CPC ..... B65B 3/04; B65B 31/003; B65B 31/10; B65B 81/3222
See application file for complete search history.

(56) References Cited

U.S. PATENT DOCUMENTS 3,995,778 A * 12/1976 Gamadia ..... B65D 83/62 222/399
5,439,137 A * 8/1995 Grollier ..... B65D 83/673 222/394

(Continued)

FOREIGN PATENT DOCUMENTS

EP 1979253 A1 10/2008
WO 2007/081210 A1 7/2007
WO 2017/207962 A1 12/2017

*Primary Examiner* — Nicolas A Arnett
(74) *Attorney, Agent, or Firm* — Ipsilon USA—NLO

(57) ABSTRACT

The invention relates to a method of filling a container (62) and to a pressurizing unit (60) comprising a first and a second pressurizing station (64,75). A transport member (61) transports the containers (62) along the pressurizing stations (64,75). An applicator (66) supplies a liquid pressurizing medium into the containers (62) at the first pressurizing station (64). A feeding unit (68) closes the containers with a cap (70). The cap has an additive chamber that is in fluid communication with the container interior via a valve. The applicator (77) at the second pressurizing station (75) supplies liquid pressuring medium to the additive chamber of the cap (70). A sealing station (80) seals the additive chamber such that the pressure 10 inside the additive chamber is lower than the pressure in the container. Upon opening of the cap by a consumer, the contents of the additive chamber are injected into the container.

14 Claims, 5 Drawing Sheets

(56) References Cited

U.S. PATENT DOCUMENTS

| | | | | | |
|---|---|---|---|---|---|
| 5,584,165 | A * | 12/1996 | Wright | B65D 85/73 | 426/115 |
| 5,705,209 | A * | 1/1998 | Wright | B65D 85/73 | 426/118 |
| 7,832,184 | B2 * | 11/2010 | Sillince | B65D 81/3222 | 53/511 |
| 8,464,883 | B2 * | 6/2013 | Seelhofer | B65D 51/2864 | 215/DIG. 8 |
| 8,590,700 | B2 * | 11/2013 | Yang | B65D 47/141 | 206/219 |
| 9,745,115 | B2 * | 8/2017 | Hall | B65D 81/3211 | |
| 2001/0001196 | A1 * | 5/2001 | Hawthorne | B65D 81/3222 | 206/219 |
| 2003/0148003 | A1 * | 8/2003 | Wright | B65D 81/3222 | 426/118 |
| 2009/0301032 | A1 * | 12/2009 | Sillince | B65D 81/3222 | 215/6 |
| 2017/0290358 | A1 * | 10/2017 | Weng | B67C 7/00 | |

* cited by examiner

METHOD AND FILLING STATION FOR FILLING A CONTAINER COMPRISING A PRESSURIZED ADDITIVE CHAMBER

FIELD OF THE INVENTION

The invention relates to a method of filling a container comprising the steps of placing a liquefied or solid gas pressurizing medium in a container having an outflow opening and containing a substance, closing off the outflow opening of the container with a closure member, the closure member comprising an additive chamber and a valve, by placing the valve in fluid communication with the pressurized container in such a manner that the valve is in a closed position when contacted by the pressure in the container.

The invention also relates to a filling station for carrying out the filling method.

BACKGROUND OF THE INVENTION

In EP1979253, a container, such as a bottle is described, comprising a pressurized beverage. The known bottle is filled at a bottling line and the beverage is placed in the bottle at an overpressure relative to ambient by introducing a droplet of liquid nitrogen into the bottle, followed by immediately closing the bottle with a cap. The nitrogen boils in the head space of the bottle and the resulting expanding nitrogen gas creates an overpressure. The cap comprises a sealed and pressurized additive chamber with an additive product, such as a flavorant, colorant, vitamins, pharmaceutical composition, and the like. The additive chamber is sealed at a pressure that is higher than ambient pressure and lower than the pressure in the headspace of the bottle. The additive chamber is placed in fluid communication with the interior of the bottle via a one-way valve, such as a duck bill or umbrella valve, which is closed by the overpressure in the bottle acting on the valve. When the cap is turned by a user to open the bottle, the overpressure in the bottle is released and the pressure in the head space of the bottle drops below the pressure inside the additive chamber, so that the contents are released from the additive chamber into the bottle.

From WO2017/207962, a container closure is known with a cap that is screwed onto a threaded neck of a bottle. The cap has a pre-filled and pressurized additive chamber that is closed by a plug member and that releases its contents into the bottle when the cap is released from the bottle and the pressure in the head space of the bottle drops below the pressure in the additive chamber.

The known filling methods utilize pre-filled additive capsules that are filled and pressurized at a different location and are then transported to the assembly site, such as a bottling line, to be applied to a container immediately after filling it with a product. This involves relatively complex logistics and requires careful handling and transportation of the pre-charged capsules to prevent damage and to ensure that the right contents, meeting the appropriate quality and safety standards, are present at the assembly site. The known container comprises a relatively large number of components, in particular two duck bill valves. It is an object of the invention to provide a filling method and a filling station in which the pressurization of the filled bottle and the step of connecting a capsule with additive substance to the bottle can be accurately controlled. It is again an object to provide a filling method and filling station that reduce the number of components of the container and additive chamber. It is another object of the invention to provide a versatile and rapid filling station for assembling a pressurized bottle and additive chamber.

SUMMARY OF THE INVENTION

Hereto a method according to the invention comprises the steps of placing an additive substance and a liquefied or solid gas pressurizing medium into the additive chamber of the closure member such that a pressure in the additive chamber is smaller than the pressure inside the container and larger than an atmospheric pressure and sealing the additive chamber.

By introducing a liquefied or solid gas pressurizing medium both in the container and in the capsule, the bottle and container can be pressurized in the same filling station, with only a small time in between the pressurizing steps. Hereby the ambient temperature and pressure, moisture content of the air and other filling conditions can be maintained at a stable setting and the pressures in the container and in the capsule can be accurately controlled. The pressure in the bottle can for instance be set at 2 bar, while the pressure in the additive chamber can be set at 1 bar, each pressure having a variation of no more than 3%.

By filling the additive chamber with a liquefied or solid gas pressurizing medium, the filled and pressurized additive chamber can be sealed while the pressure is building up to the required levels and excess of pressurizing gas is allowed to escape during the sealing process. By tailoring the amount of pressurizing agent, the escape of gas during the welding process can be taken into account so that sufficient time is available for obtaining a proper closure for the welding technique that is used, for instance by using ultrasonic welding, or any other suitable closing method, while arriving at the required end pressure in the sealed additive chamber.

The short time present between the filling and pressurizing of the bottle and the filling and pressurizing of the capsule and the use of the same pressurizing medium in the container and in the chamber, allows for proper control of the quality and consistency of the product in the container and of the additive substance in the additive chamber.

The amounts of liquefied or solid gas pressurizing medium that are applied can be accurately dosed. With the term "liquefied" and "solid" gas it is intended to describe the state of the pressurizing medium at the moment of application, where at ambient temperature and pressure the pressure medium is a gas.

After application of the solid or liquid pressurizing medium into the product chamber or into the additive chamber, the pressurizing medium evaporates. In the short time following application of the pressurizing medium, the seal can be applied to the product chamber and to the additive chamber, so that the sealed head space is filled with pressurizing gas. By setting the time interval between the application of the pressurizing medium and the application of the seal, the amount of pressurizing medium that is evaporated and passes to ambient can be varied and the pressure in the head space can be controlled.

The additive chamber containing an additive substance may be integrated with the closure member that seals the outflow opening of the container. The closure member may comprise a plug, an adhesive seal or for instance a threaded cap that can be screwed on a complementary threaded neck of the container. The container may be pressurized by introducing the liquid pressurizing medium through the outflow opening followed by sealing the pressurized container by applying the closure member with the additive chamber over the outflow opening. Thereafter, the additive substance and liquid pressurizing medium can be introduced into the additive chamber which may next be sealed.

Preferably a sealing member is used for sealing of the additive chamber, which has no valve function, such as a closed cap, plug or film. In this way, the use of an expensive and sensitive valve element in the additive chamber is avoided, reducing the cost, and improving accurate operation of the filled container and additive chamber.

In an embodiment, the additive chamber is separate from the closure member of the container. After filling and pressurizing of the container via the outflow opening and placing the closure member over the outflow opening, the additive chamber may be brought into contact with the container, for instance by being inserted into a recess in the container wall, after which the additive chamber is filled, pressurized and sealed.

The substance in the container can be a beverage or a medical liquid or can be a chemical substance that is not intended for consumption, such as for instance a paint or an adhesive. The substance in the container is free flowing and can be in liquid form or in the form of a paste or powder.

The substance in the additive chamber can be a flavoring, a colorant, vitamins, a medical composition or can be a chemical substance that is not intended for consumption, such as for instance a component of a two-component adhesive or paint system. The substance in the additive chamber is free flowing and can be in liquid form or in the form of a paste or powder so that it is easily ejected from the additive chamber and easily mixes with the container contents.

The pressuring medium comprises a liquefied or solid gas, such as liquid Nitrogen or solid $CO_2$.

The pressurizing medium may for the container and for the additive chamber comprise different liquefied or solid gasses that result in a different pressure when they evaporate in the head space of the container and the additive chamber. Alternatively, the pressurizing medium may comprise a single type of liquefied or solid gas that is applied to the container and to the additive chamber in different amounts prior to sealing.

After application of the liquefied or solid gas pressurizing medium to the additive chamber, gas may be allowed to evaporate from the additive chamber until the pressure in the additive chamber is below the pressure in the container.

An embodiment of a method of filling a container according to the invention comprises the steps of:

feeding a container holding a substance, to a pressurizing unit, moving the container along a first pressurizing station having an applicator member that places a liquid or solid pressurizing medium into the filled container, feeding a cap to the filled container comprising a one-way valve and an additive chamber, closing the container with the cap while placing the valve in fluid communication with the pressurized container in such a manner that the valve is in a closed position by contact with the pressure in the container, feeding the cap to a filling station and placing an additive substance in the additive chamber, feeding the assembled container and capsule along the second pressurizing station, placing a liquid or solid pressurizing medium into the additive chamber such that a pressure in the additive chamber is lower than the pressure in the container, feeding the assembled container and cap along a sealing station, and placing a seal on the additive chamber of the cap.

The applicator at the first pressurizing station may supply a first amount of liquefied or solid pressure medium from a first supply. At the second pressurizing station, a second amount of the pressurizing medium is fed from the same supply, which second amount can be smaller than the first amount or which is similar but is left to evaporate before sealing of the additive chamber such that the pressure in the additive chamber is at the desired lower value.

The applicator and the sealing station may be situated along a rotating feeding station, such as a carousel.

An embodiment of a filling station according to the invention comprises a first and a second pressurizing station, a transport member for transporting containers along the pressurizing stations, an applicator that is adapted to supply liquid or solid pressurizing medium into the containers at the first pressurizing station, a feeding unit adapted to supply a cap with an additive chamber and closing off the pressurized container with the cap downstream from the first pressurizing station, such that a pressure inside the container is at a first pressure value, wherein at the second pressurizing station the applicator is adapted to supply liquid or solid pressuring medium to the additive chamber and a sealing station adapted to seal the additive chamber such that the pressure inside the additive chamber is lower than the pressure in the container.

The additive chamber may be supplied in a filled state to the filling station or an additive fill station for filling of the additive chamber with an additive product may be situated between the first and second pressurizing stations.

In an embodiment of a filling station, the applicator at the second filling station is adapted to supply a second amount of liquid pressurizing medium that differs from a first amount of pressurizing medium that is supplied at the first pressurizing station.

By adjusting the volume of a single type of pressuring medium for the container and for the additive chamber, a relatively simple and accurate pressurizing station is provided. The required pressure can also be obtained by setting the timing after which the seal is applied, so that the amount of gas that escapes is controlled prior to sealing and the pressure is set.

The method according to the invention can be applied in the field of beverages, cosmetics, pharmaceutics, or chemicals.

Although the filling method according to the invention can have various applications, it is particularly suitable for the filling of containers containing beverages. For beverage applications, the additive within the container can comprise vitamins. A product that contains vitamins is usually perishable because the vitamins in contact with the liquid product will not be stable for a long time, e.g., due to oxidation. According to the invention the vitamins in the additive chamber are kept in optimum condition. After the consumer removes the closure member the vitamins are injected into the product container and the vitamins are consumed at their highest functionality. Thus, it is very simple to prepare a beverage containing "freshly" added vitamins. For example, it is known that vitamin C will deteriorate in aqueous and alcoholic liquids, i.e., it is difficult to keep an aqueous and/or alcoholic beverage containing added vitamin C. According to the invention an aqueous and/or alcoholic product and the vitamin C additive can be separately contained within the container, whereas they are mixed only just before consumption by opening the container.

It is possible according to the invention that the additive comprises proteins and/or peptides, such as casein hydrolysates, and/or carotenoids, such as lycopene, and/or anti-oxidants, such as quercitin, and/or flavourants, such as a flavored concentrate or flavor extracts. Proteins and peptides have several functionalities. For example, various proteins and peptides are "muscle refueling". However, these compounds deteriorate in alcohol. Consequently, they may cause a bitter taste and/or decreased functionality. With a container filled by the method according to the invention, it is possible to produce an alcoholic sports drink. The alcoholic product, such as beer, is then filled in the product chamber, whereas the additive chamber contains casein hydrolysates or any other proteins and/or peptides. Such a "sports beer" is particularly advantageous according to the invention.

Proteins and peptides also deteriorate in acid liquids, i.e., liquids having pH<7. Most soft drinks, such as cola, are acid. The container that is filled according to the invention also enables the combination of an acid soft drink in the product chamber and proteins and/or peptides in the additive chamber, which results in a "sports soft drink". This combination is also advantageous according to the invention.

Carotenoids, such as lycopene, improve sight of the consumer. Depending on the pH-value, they will influence the overall color of the beverage. Anti-oxidants, such as qeurcitin, have various functionalities as well. For example, anti-oxidants are believed to reduce the formation of wrinkles. Therefore, these additives are also particularly advantageous for being received in the additive chamber of the container according to the invention. The filling method according to the invention allows these additives to be combined with water, beer, milk, or any other product—contrary to known containers wherein these additives cannot be kept separated from the product.

As an example of a flavorant, such as a flavored concentrate, the product within the product chamber is still or carbonated water, whereas the additive chamber is charged with liquid syrup. One packaging company can fill the product chambers of the container according to the invention, whereas another company can charge the additive chamber with a flavored ingredient and fit the additive chamber to the containers. Thus, it is possible to supply a range of flavors of carbonated and still products. The company installing the additive chamber may also be catering industry selling various flavored drinks or health drinks over the counter.

Many carotenoids, such as lycopene, anti-oxidants, such as quercitin, and flavourants are known to deteriorate under the influence of light. In this case, the additive chamber of the container according to the invention is nontransparent or opaque, whereas the product container can be transparent.

The container according to the invention is also suitable for medical applications. In this case, it is possible according to the invention that the product and the additive after mixing thereof comprise a pharmaceutical composition, in particular a medicament. The pharmaceutical composition may require mixing of different components only at the time of use. The container according to the invention provides accurate dosing of these different components—human mistakes are excluded because dosing is automatic. Moreover, the mixing of the different components is completely hygienic.

The filling method according to the invention is also suitable for use with cosmetic applications. The container can contain a product and an additive that after mixing thereof comprise a cosmetic composition, such as a skin lotion. The cosmetic industry has developed packages for lotions and skin systems that rely on mixing of two or more components at the time of use, e.g., twin pack systems. However, these packages are relatively expensive and do not provide automatic mixing. The container according to the invention provides an inexpensive alternative for packaging of such cosmetic products.

It may be desirable that the additive comprises more than one composition. In a preferred embodiment of the invention the additive comprises at least two liquid compositions that separate after mixing, for example compositions having different densities and/or incompatible chemical properties. Because of the different densities and/or chemical incompatibility these two liquid components float on top of each other within the additive chamber. After depressurizing the product chamber, the additive chamber will discharge the liquid components successively. If the liquid components have different colors the consumer will see multiple jets of different colors flowing into the product chamber.

The color injection may function as a tamper proof closure, with the colors indicating that an opening of the closure has taken place.

The product contained in the container can be any flowable material, such as a powder, a paste, or a liquid.

Another field of application of the filling method according to the invention is the use of pressure indicators, for instance on powder-based fire extinguishers or on gas tanks, wherein a pressure loss in the container results in the additive chamber being emptied, thus giving an indication of pressure loss.

BRIEF DESCRIPTION OF THE DRAWINGS

An embodiment of a method of filling a container and a filling station according to the invention will by way of non-limiting example, be described in detail with reference to the accompanying drawings. In the drawings.

DETAILED DESCRIPTION OF EMBODIMENTS

Figure 1:
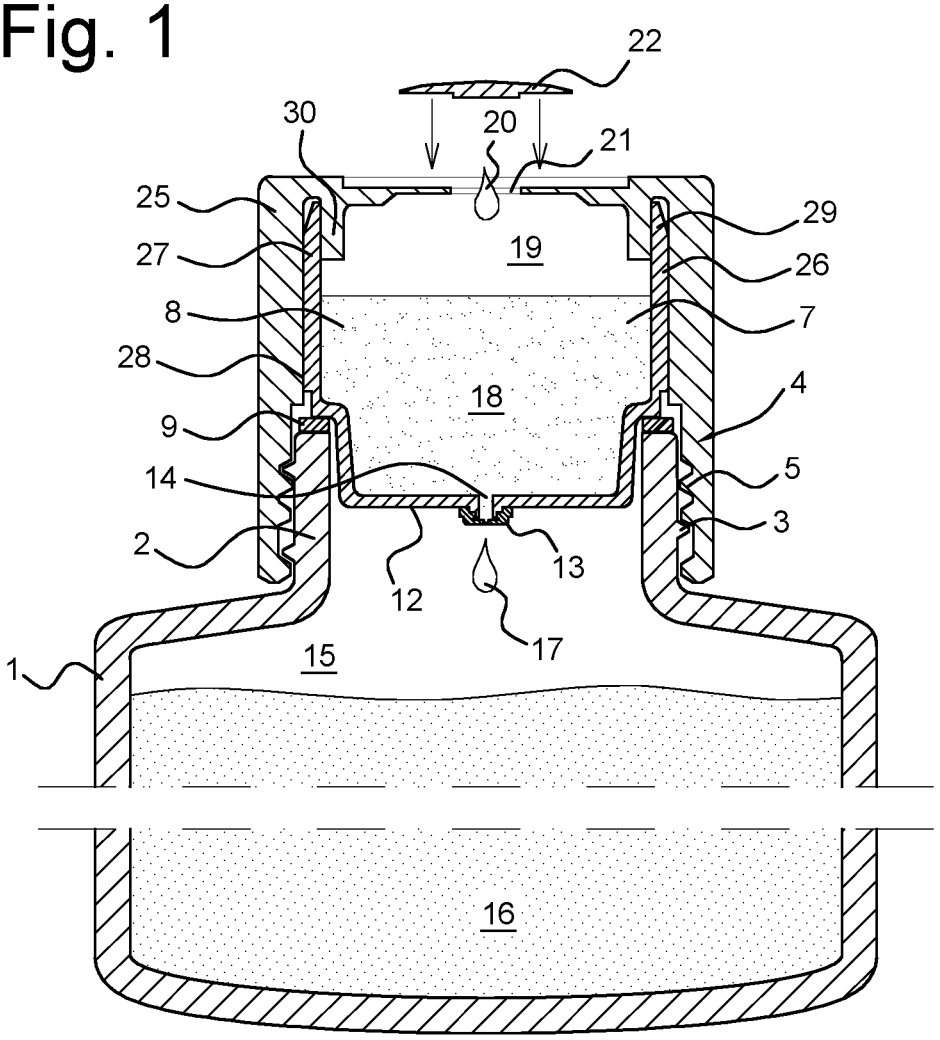
FIG. 1 shows the pressurization of a container with a cap and additive chamber according to the invention, FIGS. 2*a*-2*d* schematically show an embodiment of a method of pressurizing according to the invention wherein a bottle is filled via its neck, FIGS. 3*a*-3*b* schematically show an embodiment, wherein the bottle is filled through its bottom, FIGS. 4*a*-4*d* schematically show an embodiment using a separate cap and additive chamber, FIGS. 5*a*-5*d* schematically show another embodiment of a method according to the invention.

FIG. 1 shows a container in the form of a bottle 1 with a neck 2 having a thread 3. A cap 4 engages via an internal thread 5 with the threaded neck 2. The cap 4 comprises and additive chamber 7 holding an additive substance 8. The cap sealingly engages with a seal 9 of neck 2. At the bottom surface 12 of the chamber 7, an exit opening 14 is provided that is closed by a valve 13. The valve 13 is closed by an overpressure in the head space 15 situated over the product chamber 16. The overpressure may for instance be 2 bars and is provided by introducing a drop 17 of liquid nitrogen into the interior of the bottle 1 via the open neck 2. This has been schematically indicated.

After placing the drop of nitrogen 17 into the bottle 1, the cap 4 is placed on the neck 2 to seal the bottle. The liquid nitrogen will boil to return to its gaseous state and fill the head space 15, while closing the valve 13. Shortly prior to, or after placing the cap 4, an additive substance 18 is placed into the additive chamber 7. A drop of liquid nitrogen 20 is introduced into the additive chamber 7 and a seal 22 is applied, for instance by ultrasonic welding, to seal the chamber 7. The nitrogen 20 returns to its gaseous state and results in a pressure of 1 bar in the headspace 19.

The cap 4 has an outer sleeve 25 and an inner reservoir 26 with a wall 27 that slidingly engages with an inner surface 28 of the outer sleeve 25. The upper section 29 of the wall 27 is supported within the annular cavity defined by the inner annular ridge 30 that extends from the top of the cap 4.

When the outer sleeve is turned by a user to open the bottle 1, the outer sleeve 25 is moved upward. The internal pressure in the headspace 15 presses the inner reservoir 26 upward so that it comes away from the seal 9 and the pressure of the headspace 15 is released to the ambient. This causes a drop in pressure that will cause the valve 13 to open under the influence of the pressure in the headspace 19 and the contents of the additive chamber 7 will be injected into the product chamber 16 of the bottle 1, to mix with the product that is contained in the product chamber 16.

FIGS. 2*a*-2*d* show the steps of filling a container 35 with a liquid product 36 through the container neck 37 in step a, and introducing a droplet of a liquid pressurizing medium 38 through the neck 37 in step b. Then the cap 39 is placed on the neck 37 with the valve 40 in contact with the head space 45 so that it is closed by the head space pressure. An additive substance 42 is placed in the additive chamber 41 and a droplet 43 of pressurizing medium 43 is introduced in the chamber 41. I step d, a seal 46 is applied on the cap 39 by ultrasonic welding.

Figure 2A:
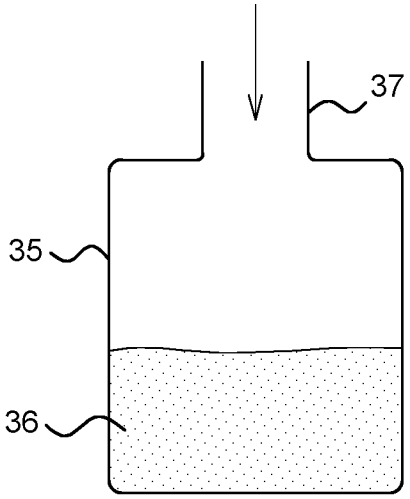
Figure 2B:
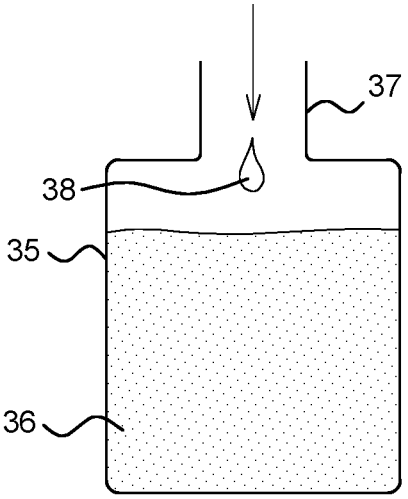
Figure 2C:
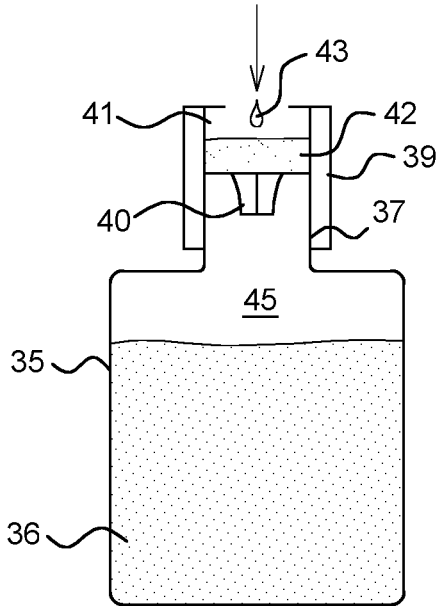
Figure 2D:
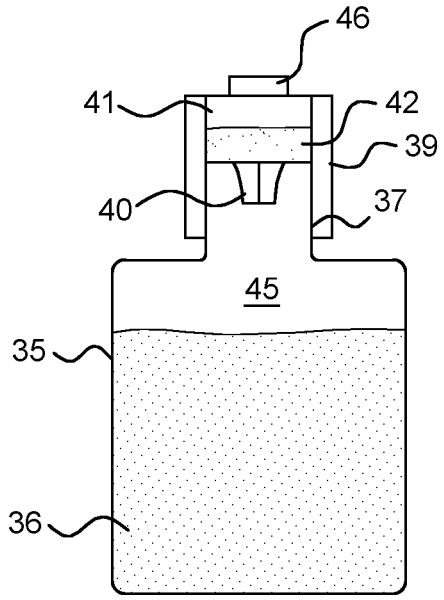
Figure 3A:
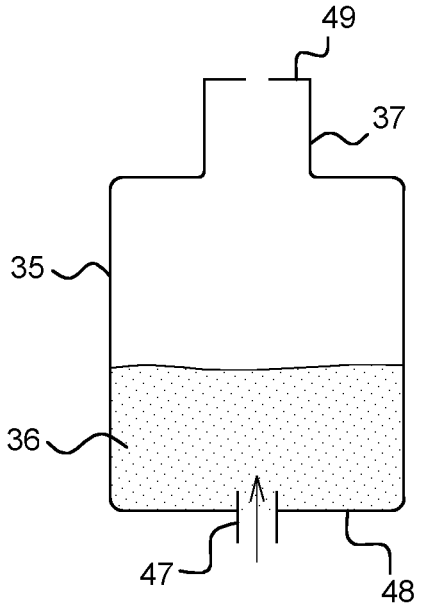
Figure 3B:
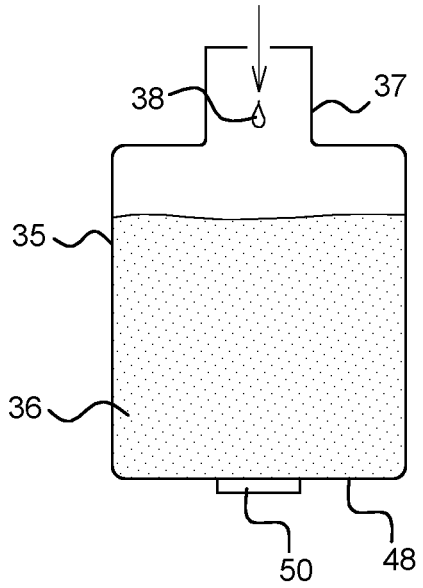

In FIGS. 3*a* and 3*b* it is illustrated that a container 35 is filled via a fill nozzle 47 through the bottom of the container, via a relatively large fill opening that allows rapid filling. The neck 37 comprises a small opening 49 through which the drop of pressurizing substance 38 is introduced in step 3*b*. A seal 50 is applied to close off the fill opening at the bottom 48 prior to carrying out the introduction of the pressurizing substance 38. Following step 3*b*, a cap 39 comprising an additive chamber 41 can be applied to the neck 37 and which can be pressurized in the same manner as illustrated in FIGS. 2*c* and 2*d*.

Figure 4A:
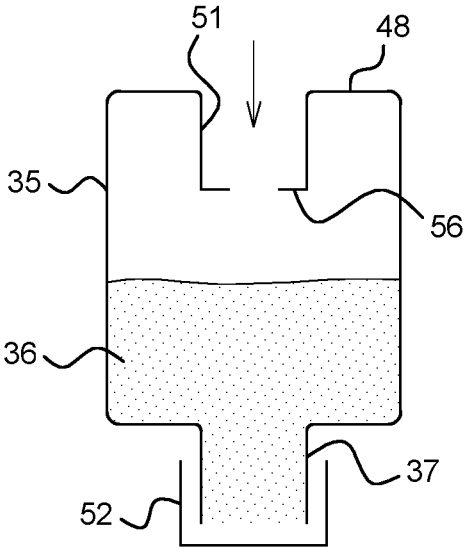
Figure 4B:
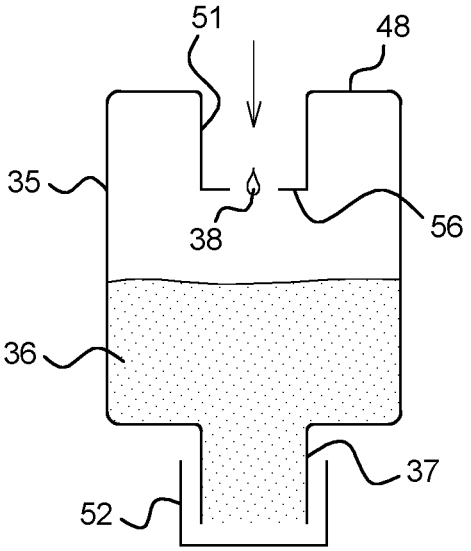
Figure 4C:
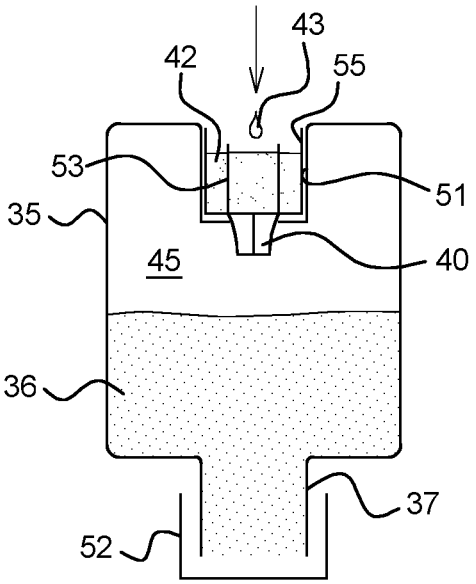
Figure 4D:
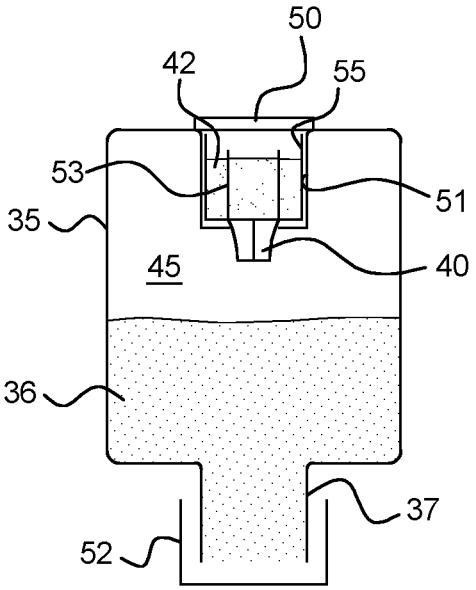

In FIGS. 4*a*-4*d* it is illustrated that the cap 52 that closes off the outflow opening of the neck 37 of the container 35 and the capsule 55 containing the additive substance, are separate component parts. The cap 52 closes off the outflow opening in the neck 37 while the capsule 55 is accommodated in a recess 51 in the bottom 48 of the container 35. The capsule 55 is provided with a riser tube 53 that allows the additive chamber to be emptied when the capsule is turned around so that the valve 40 faces upwards. As shown in FIG. 4*a*, the container 35 is filled with product 36 in an upside-down orientation, with the cap 52 on the neck 37, through a fill opening 56 in the recess 51. In FIG. 4*b*, the pressurizing medium is introduced through the fill opening 56. In FIG. 4*c*, it shown that the capsule 55 is placed in the recess 51 with the valve 40 in contact with the pressurized head space 45. The capsule 55 is filled with the additive substance 42 and the drop 43 of liquefied or solid or solid gas is applied. In FIG. 4*d*, a seal 50 is applied closing off the recess 51 and fixing the capsule 55 in position.

Figure 5A:
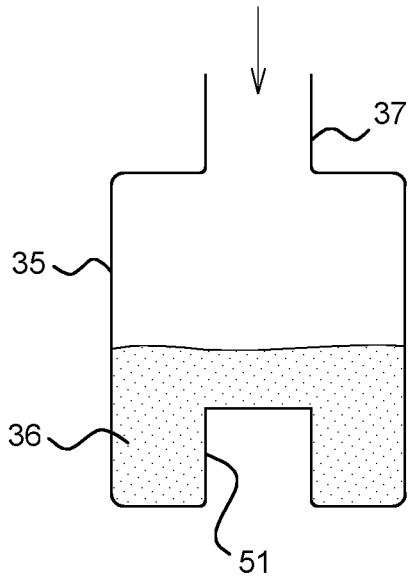
Figure 5B:
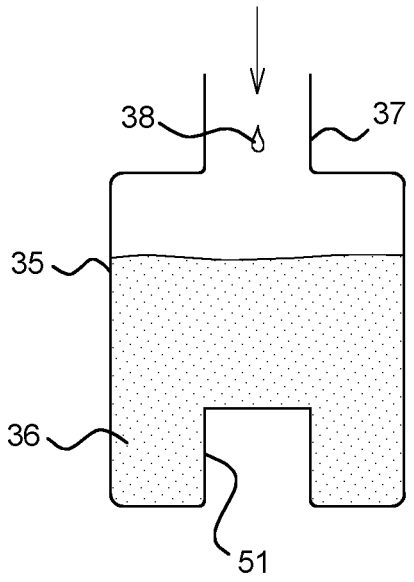
Figure 5C:
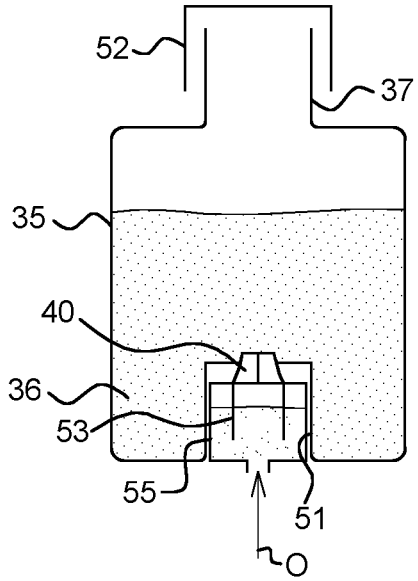
Figure 5D:
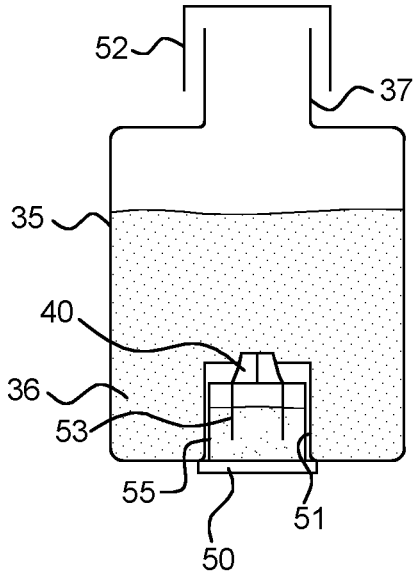

In FIGS. 5*a*-5*d* an embodiment is described in which the container 35 is filled with product 36 through its neck 37. After introducing the pressurizing medium 38, the neck 37 is closed off with a cap 52 as shown in FIG. 5*c*. The capsule 55 is inserted into the recess 51 such that the valve 40 projects through the container wall and is contact with the container interior. The capsule 55 with the riser tube 53, is filled and pressurized through the bottom of the capsule and in step 5*d* a seal 50 is applied. The container 35 with the cap 52 in place may be turned upside down, prior to inserting the capsule 55 into the recess 51 as shown in FIG. 5*c*. This will provide easy filling and pressurizing of the capsule 55 under gravity flow conditions.

Figure 6:
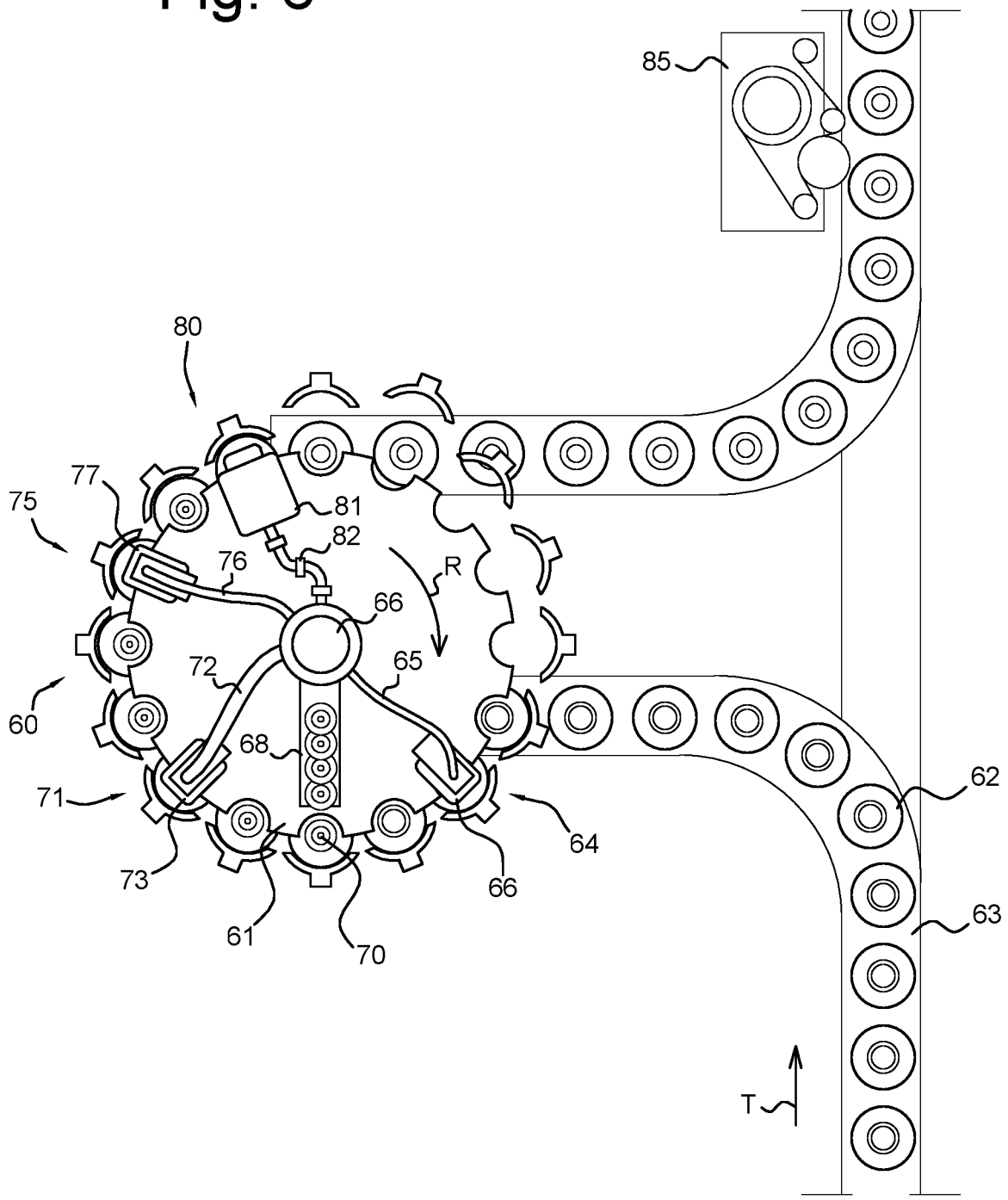
FIG. 6 shows a pressurizing unit according to the invention.

FIG. 6 shows a pressurizing unit 60 comprising a carousel 61, rotating in the direction of the arrow R. The carousel 61 receives filled bottles 62 that are transported on a conveyor 63 in the direction of the arrow T. The pressuring unit 60 comprises a first pressurizing station 64 with an arm 65 supporting on its end an applicator 66 through which a drop of liquid nitrogen is supplied from a central supply 67 and is introduced into the bottles via their open necks.

The bottles next rotate along a cap feeding and placement station 68 that connects the caps 70, having empty additive chambers, onto the bottles, which are thereby sealed at a pressure of for instance 2 bars.

In the filling station 71, the additive chambers of the caps 70 are filled with an additive substance, via an arm 72 and an applicator 73.

In a second pressuring station 75, an applicator 77 at the end of arm 76 introduces a drop of liquid nitrogen into the filled additive chamber of the caps 70. In a sealing station 80, comprising an ultrasonic welding head 81 on an arm 82, a seal is placed on the filled additive chambers.

The amount of liquid nitrogen that is supplied by the second pressurizing station 75 can be smaller than the amount of that is supplied in the first pressurizing station 64, so that after applying the seal on the additive chamber, the pressure in the headspace of the additive chamber is lower than the pressure in the container and measures for instance 1 bar. It is also possible for the first and second pressurizing stations 64, 75 to supply equal amounts of liquid nitrogen, and to adjust the time for transporting the filled additive chamber from the second pressurizing station 75 to the sealing station 80 to allow sufficient nitrogen to evaporate into the ambient and for the pressure in the additive chamber to reach the desired value.

In another embodiment, different liquefied or solid or solid gasses may be employed in the pressurizing stations 64 and 75 for pressuring the container and the additive chamber at their respective pressures.

After completing the sealing step, the filled bottles are transported back onto the conveyor 63 and are transported past a labelling station 85 for labelling and are forwarded to a packaging unit.

The invention claimed is:

1. A method of filling a container comprising:

Placing a pressurizing medium in a container having an outflow opening and containing a substance, Closing off the outflow opening of the container with a closure member, either prior to or after placing the pressurizing medium in the container, the closure member comprising an additive chamber and a valve, Placing the valve in fluid communication with the pressurized container in such a manner that the valve is in a closed position when contacted by the pressure in the container, characterized by Placing an additive substance and a liquefied or solid gas pressurizing medium into the additive chamber of the closure member via an additive fill opening, allowing the liquefied or solid gas pressurizing medium to evaporate and build pressure in the additive chamber, Sealing the additive fill opening by ultrasonic welding while the pressure is building up in the additive chamber such that there is a predetermined pressure in the additive chamber that is smaller than the pressure inside the container and larger than an atmospheric pressure, wherein the seal does not comprise a valve.

2. The method according to claim 1, wherein the pressurizing medium comprises the same gas that is applied to the container and to the additive chamber in different amounts.

3. The method according to claim 1, wherein after application of the liquefied or solid gas pressurizing medium to the additive chamber, gas is allowed to evaporate from the additive chamber until the pressure in the additive chamber is below the pressure in the container.

4. The method according to claim 1, wherein the pressurizing medium in the container comprises a liquified or solid gas pressurizing medium and is placed in the container prior to closing off the outflow opening of the container with the closure member.

5. The method according to claim 4, wherein the pressurizing medium comprises the same gas that is applied to the container and to the additive chamber in different amounts.

6. The method according to claim 4, wherein after application of the liquefied or solid gas pressurizing medium to the additive chamber, gas is allowed to evaporate from the additive chamber until the pressure in the additive chamber is below the pressure in the container.

7. A method of filling a container comprising:

feeding a container holding a substance, to a pressurizing unit, moving the container along a first pressurizing station having an applicator that places a pressurizing medium into the filled container, feeding a cap to the filled container comprising a valve and an additive chamber, closing the container with the cap either prior to or after placing the pressurizing medium in the container, placing the valve in fluid communication with the pressurized container in such a manner that the valve is in a closed position by contact with the pressure in the container, feeding the assembled container and cap along a second pressurizing station, placing a liquid or solid pressurizing medium into the additive chamber via an additive fill opening such that a pressure in the additive chamber is lower than the pressure in the container, allowing a predetermined time interval for the liquefied or solid pressurizing medium to evaporate and for excess pressurizing gas to escape from the additive chamber, after a predetermined time interval, feeding the assembled container and cap along a sealing station, and placing a pressure sealing member on the additive fill opening of the additive chamber of the cap, wherein the pressure sealing member does not comprise a valve, wherein the predetermined time interval is set such that the pressure in the additive chamber reaches a controlled value lower than the pressure in the container.

8. The method according to claim 7, wherein an applicator at the first pressurizing station supplies a first amount of liquified or solid pressurizing medium and at the second pressurizing station an applicator supplies a second amount of the pressurizing medium that is smaller than the first amount.

9. The method according to claim 8 in which the applicator and the sealing station are situated along a rotating feeding station.

10. The method according to claim 7 in which the applicator and the sealing station are situated along a rotating feeding station.

11. A pressurizing unit comprising a first and a second pressurizing stations, a transport member for transporting containers along the pressurizing stations, an applicator that is adapted to supply pressurizing medium into the containers at the first pressurizing station, a feeding unit adapted to supply a cap with an additive chamber and closing off the pressurized container with the cap, upstream or downstream from the first pressurizing station, such that a pressure inside the container is at a first pressure value, wherein the applicator at the second pressurizing station is adapted to supply liquid or solid pressuring medium to the additive chamber of the cap via an additive fill opening and a sealing station adapted to seal the additive chamber with a pressure sealing member not comprising a valve, such that the pressure inside the additive chamber is lower than the pressure in the container.

12. The pressurizing unit according to claim 11, wherein the applicator at the first pressurizing station is adapted to supply a first amount of liquid or solid pressurizing medium into the containers, and wherein the applicator at the second pressurizing station being adapted to supply a second amount of liquid or solid pressurizing medium that differs from a first amount of pressurizing medium that is supplied by the applicator at the first pressurizing station.

13. The pressurizing unit according to claim 12, comprising between the first and second pressurizing stations, an additive filling station for filling of the additive chamber with an additive product.

14. The pressurizing unit according to claim 11, comprising between the first and second pressurizing stations, an additive filling station for filling of the additive chamber with an additive product.

* * * * *